US008821112B2

(12) United States Patent
Garrett

(10) Patent No.: US 8,821,112 B2
(45) Date of Patent: Sep. 2, 2014

(54) VARIABLE GEOMETRY TURBINE

(75) Inventor: Stephen Edward Garrett, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 880 days.

(21) Appl. No.: 13/000,203

(22) PCT Filed: Jun. 10, 2009

(86) PCT No.: PCT/GB2009/001454
§ 371 (c)(1),
(2), (4) Date: Dec. 20, 2010

(87) PCT Pub. No.: WO2009/153546
PCT Pub. Date: Dec. 23, 2009

(65) Prior Publication Data

US 2011/0100000 A1 May 5, 2011

(30) Foreign Application Priority Data

Jun. 19, 2008 (GB) ..... 0811228.6

(51) Int. Cl.
*F04D 29/46* (2006.01)
*F01D 17/16* (2006.01)
*F01D 17/14* (2006.01)
*F01D 9/02* (2006.01)

(52) U.S. Cl.
CPC ..... *F01D 17/143* (2013.01); *F05D 2220/40* (2013.01); *F01D 17/167* (2013.01); *F01D 9/026* (2013.01)
USPC ..... 415/157; 415/165

(58) Field of Classification Search
USPC ..... 415/157, 158, 161, 162, 165
See application file for complete search history.

(56) References Cited

U.S. PATENT DOCUMENTS 4,403,914 A 9/1983 Rogo et al.
4,499,732 A 2/1985 Szczupak et al.
(Continued)

FOREIGN PATENT DOCUMENTS

DE 3151414 A1 6/1983
EP 0334915 A1 9/1981
(Continued)

OTHER PUBLICATIONS

International Search Report, Cummins Turbo Technologies Limited, PCT/GB2009/001454, Sep. 27, 2010.
(Continued)

*Primary Examiner* — Dwayne J White
(74) *Attorney, Agent, or Firm* — Krieg DeVault LLP; Clifford W. Browning

(57) ABSTRACT

A variable geometry turbine comprises a turbine wheel supported in a housing for rotation about a turbine axis. The housing defines an annular inlet passage around an inducer portion of the turbine wheel and an outlet passage including a tubular wall disposed around an exducer portion of the turbine wheel; the inlet passage is defined between first and second radial inlet surfaces, one of the inlet surfaces being defined by a moveable wall member and the other of the inlet surfaces being defined by a facing wall of said housing. The moveable wall member is moveable relative to the facing wall of the housing along the turbine axis to vary the size of the inlet passageway. The moveable wall member is displaceably mounted within an annular cavity defined between the tubular wall and a surrounding wall of the housing.

42 Claims, 8 Drawing Sheets

(56) References Cited

U.S. PATENT DOCUMENTS

| | | | |
|---|---|---|---|
| 4,557,665 | A | 12/1985 | Szczupak |
| 4,571,154 | A | 2/1986 | Weber |
| 5,701,741 | A | 12/1997 | Halsall |
| 5,868,552 | A | 2/1999 | McKean et al. |
| 6,224,333 | B1 | 5/2001 | Loeffler et al. |
| 6,694,733 | B1 | 2/2004 | Bernardini et al. |
| 6,715,288 | B1 | 4/2004 | Engels et al. |

FOREIGN PATENT DOCUMENTS

| | | | | |
|---|---|---|---|---|
| EP | 0131406 | A2 | | 1/1985 |
| FR | 2513312 | A1 | | 3/1983 |
| GB | 2211246 | A | | 6/1989 |
| GB | 2408779 | A | | 6/2005 |
| JP | 54020213 | A | * | 2/1979 |
| WO | WO89/11583 | A1 | | 11/1989 |
| WO | WO2005/106212 | A1 | | 11/2005 |

OTHER PUBLICATIONS

International Preliminary Report on Patentability, PCT/GB2009/001454 Cummins Turbo Technologies Limited, the International Bureau of WIPO, Dec. 21, 2010.

Written Opinion, PCT/GB2009/001454, Cummins Turbo Technologies Limited, International Searching Authority/European Patent Office, Dec. 19, 2010

United Kingdom Search Report GB0811288.6, Cummins Turbo Technologies Limited, Sep. 15, 2008.

* cited by examiner

VARIABLE GEOMETRY TURBINE

CROSS REFERENCE TO RELATED APPLICATIONS

The present application is a §371 national stage patent application of PCT/GB2009/001454 filed Jun. 10, 2009, which claims priority to United Kingdom Patent Application No. 0811228.6 filed Jun. 19, 2008, each of which is incorporated herein by reference.

The present invention relates to a variable geometry turbine. Particularly, but not exclusively, the present invention relates to variable geometry turbochargers.

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In known turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. It is also known to improve turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine an axially moveable wall member, generally referred to as a "nozzle ring" defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output. The nozzle ring is provided with vanes which extend into the inlet and through slots provided in a "shroud" defining the facing wall of the inlet passageway to accommodate movement of the nozzle ring. The vanes are at a fixed angle relative to the radius of the nozzle ring. A variable geometry turbocharger including such a variable geometry turbine is for instance disclosed in U.S. Pat. No. 5,868,552.

An object of the present invention is provide a novel variable geometry turbine structure.

According to a first aspect of the present invention there is provided a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing.

In the known turbocharger mentioned above, the moveable wall member of the variable geometry turbine is mounted in an annular chamber defined by the bearing housing. Mounting the moveable wall member in an annular cavity defined on the exducer side of the inlet passageway avoids the need for a specially designed bearing housing to accommodate the moveable wall member and actuator mechanism. This may be useful for instance to enable a standardised bearing housing to be used for both fixed geometry and variable geometry turbines. The present invention also enables the size of the bearing housing to be reduced as compared with a bearing housing which must accommodate a variable geometry mechanism, which may also be advantageous in some applications.

As the turbine wheel rotates, it sweeps out a tubular surface known as the profile of the wheel. In many applications it is preferable for the exducer portion of the turbine wheel to sweep out a tubular profile which varies in radius along the axis of the turbine—typically reducing in radius in a direction away from the inducer portion of the turbine wheel. Such a turbine wheel profile is known to improve efficiency. The radius may reduce gradually so that the profile is curved. In accordance with the present invention the inner tubular surface defined by the tubular wall may be profiled to match (or at least substantially match, for example approximate to) the profile of the exducer portion of the turbine wheel. This allows the wheel to have an efficient profile whilst also avoiding an undesirably large gap between the exducer portion of the turbine wheel and the tubular wall which may reduce efficiency.

The surrounding wall (which surrounds the tubular wall) may extend axially beyond the tubular wall to define a generally tubular portion of the outlet passage downstream of the tubular wall relative to flow through the turbine.

In some embodiments, the housing comprises an inlet portion defining said inlet passage and at least a portion of the surrounding wall and an outlet portion joined to said inlet portion and defining at least a portion of said outlet passage. The outlet portion of the housing may also define at least a portion of the surrounding wall. The tubular wall may be supported by the outlet portion of the housing. This would for instance allow use of a common inlet housing portion for turbine wheels having different exducer profiles, the differing profiles being accommodated by attachment of a suitably configured outlet housing portion. The tubular wall may for instance be integrally formed with the outlet portion of the housing. For example a generally radially extending annular wall portion integral with the tubular wall and said outlet portion of the housing may extend between the two and close an axial end of the cavity remote from the inlet passage.

In some embodiments the tubular wall may be defined by a tubular wall member supported within said surrounding wall by at least one radial projection extending from said tubular wall member to said surrounding wall. The radial projection (which may for instance be a radially extending annular flange) may for example be secured (e.g. clamped) between the inlet and outlet portions of the housing. The radial projection (e.g. radially extending annular flange) may be integral with said tubular member. Turbine wheels having differing exducer profiles could therefore be accommodated by fitting an appropriately configured tubular wall member into a turbine housing without necessarily having to change any other details of the housing.

In some embodiments the moveable wall member is mounted on an end of at least one axially moveable rod, the or each rod extending through an aperture in said annular wall portion extending between the tubular wall and the surrounding wall, or radial projection providing support for a tubular wall member, for connection to an actuating mechanism. The moveable wall member may for instance be mounted on two of such axially moveable rods, and the turbine may further comprise an actuating mechanism including a beam linked to each of the rods and means for displacing the beam in a direction along the axis of the turbine to thereby axially displace the moveable wall member. The beam may for instance be disposed within the outlet passage downstream of the tubular wall and be connected to an actuator disposed outside of the outlet passage by a linkage which extends through a wall of the outlet passage. In one embodiment the outlet passage comprises a first generally tubular portion extending axially away from the tubular wall, and a second portion extending at an oblique angle to the first portion and defined at least in part by the wall of the outlet passage through which the linkage extends.

The linkage may comprise a drive rod. The drive rod may be integrally formed with the beam.

In one alternative embodiment, the moveable wall member is mounted on an end of at least one axially moveable rod, the or each rod extending through an aperture in a radially extending support wall (e.g. an annular flange) which extends between the tubular wall and the surrounding wall (the radially extending support wall being located between, for example, the inlet passage and said annular wall portion or radial projection). An actuating mechanism engages the or each rod on the opposite side of the support wall to the moveable wall member. The actuating mechanism may for instance be of the general type disclosed in U.S. Pat. No. 5,868,522 mentioned above and may comprise a yoke pivotally supported relative to the housing and defining at least one arm which extends into engagement with the or each rod. The arm or arms of the yoke may extend through the surrounding wall of the housing.

In embodiments in which the moveable wall member is mounted on such rods, the rods may be connected to the wall member by any suitable method which preferably allows for expansion of the nozzle ring. For instance, known methods of connecting support rods to moveable wall members of known variable geometry turbines, such as disclosed in U.S. Pat. No. 5,868,522 referred to above, may be utilised. Other possibilities will be known to the appropriately skilled person.

Various different forms of actuator could be used to provide a driving force for movement of the moveable wall member. Possible actuators include, but are not limited, to pneumatic, hydraulic and electric actuators.

An annular array of inlet vanes may be fixed to, and extend from, the first inlet surface, and vane slots may be provided in the second inlet surface to receive the inlet vanes as the inlet surfaces move (axially, for example) towards one another. For instance, in some embodiments the moveable wall member defines a first surface supporting an annular array of vanes which extend through a slotted facing wall of the housing, and possibly into an annular cavity defined behind said facing wall of the housing. Alternatively, the vanes may extend from the fixed wall of the housing and extend through slots provided in the moveable wall member as the moveable wall member moves towards the fixed wall of the housing.

In some embodiments, the moveable wall member may comprise a radial wall defining said inlet surface and two axially extending annular flanges which extend into said cavity from radially opposite edges of the radial wall. An annular seal may be provided between either a flange and the cavity to prevent gas flow through the cavity.

In embodiments in which inlet vanes are fixed to the first inlet surface, and the second inlet surface is defined by the moveable wall member and provided with slots to receive said vanes, the moveable wall member may define an internal annular chamber which receives said vanes.

In alternative embodiments the moveable wall member may comprise a radially extending annular wall defining said inlet surface, and an axially extending tubular wall which is slidably received within said cavity.

The turbine housing may be connected to a bearing housing defining a bearing cavity, the turbine wheel being mounted on a turbine shaft which extends through a housing wall separating the turbine wheel and bearing cavity.

According to a second aspect of the present invention there is provided a turbocharger comprising a variable geometry turbine according to the first aspect of the present invention. The turbine of the turbocharger may have, for example, one or more of the features described above in relation to the turbine of the first aspect of the present invention.

Specific embodiments of the present invention will now be described, by way of example only, with reference to the accompany drawings, in which.

Figure 1:
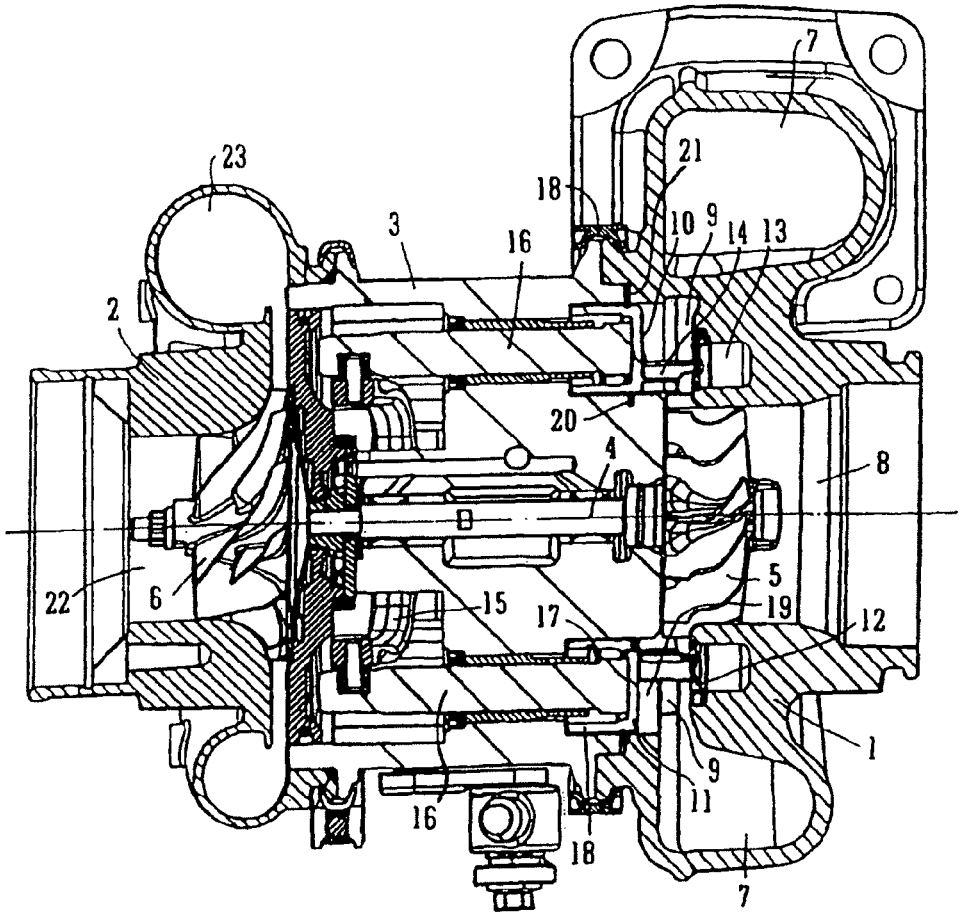
Fig. 1 Prior Art
FIG. 1 is an axial cross-section through a known variable geometry turbocharger.

Referring to FIG. 1, this illustrates a known variable geometry turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis V-V on bearing assemblies located in the bearing housing 3.

The turbine housing 1 defines an inlet volute 7 to which gas from an internal combustion engine (not shown) is delivered. The exhaust gas flows from the inlet chamber 7 to an axial outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. When the nozzle ring 11 is proximate to the annular shroud 12, the vanes 14 project through suitably configured slots in the shroud 12, into the recess 13.

The position of the nozzle ring 11 is controlled by an actuator assembly of the type disclosed in U.S. Pat. No. 5,868,552 referred to above (and which is incorporated herein by reference). An actuator (not shown) is operable to adjust the position of the nozzle ring 11 via an actuator output shaft (not shown), which is linked to a yoke 15. The yoke 15 in turn engages axially extending rods 16 that support the nozzle ring 11. Accordingly, by appropriate control of the actuator (which may for instance be pneumatic or electric), the axial position of the rods 16 and thus of the nozzle ring 11 can be controlled.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet chamber 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the face 10 of the nozzle ring 11 towards the shroud 12.

With the prior art turbocharger described above, the movable inlet wall (nozzle ring 11) is mounted within a cavity defined by the bearing housing. In contrast, the present invention provides a variable geometry turbine including a movable inlet wall member which is displacably mounted within a cavity defined in the turbine housing. The present invention is suitable for, but not limited to, a turbocharger. However, since the invention relates only to the nature of the turbine, other details of a turbocharger incorporating the present invention, such as the bearing housing and compressor details will not be described.

Figure 2:
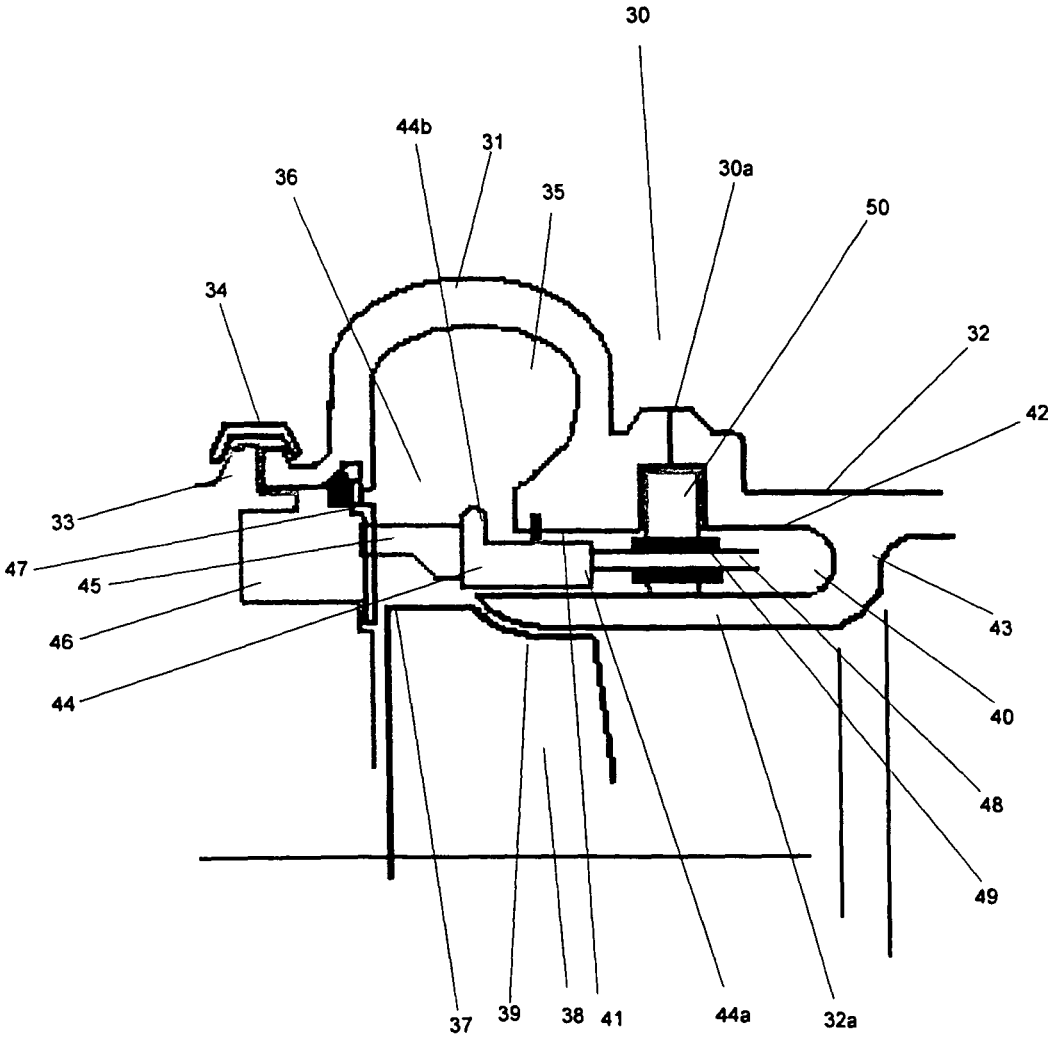
FIG. 2 shows a diagrammatic axial cross-section through a variable geometry turbine in accordance with a first embodiment of the invention.

Referring first to FIG. 2, this schematically illustrates part of a turbine housing 30 in accordance with a first embodiment of the present invention. It will be understood that the turbine housing is generally symmetric about a turbine axis. The turbine housing, indicated generally by reference 30 comprises an inlet portion 31 and an outlet portion 32. The inlet portion 31 of the turbine housing is connected to an appropriate bearing housing 33 via an annular "V-band" 34. Details of the bearing housing may be entirely conventional (for instance they correspond to those of a known fixed geometry turbocharger bearing housing) and are therefore not shown and will not be described. It is to be understood, however, that the bearing housing will include bearing assemblies for rotational support of the turbine shaft, and oil delivery passages for provision of lubricant to the bearings.

The inlet portion 31 of the turbine housing 30 defines an inlet volute 35 which leads to annular inlet passage 36 which surrounds an inducer portion 37 of a turbine wheel 38 rotatably mounted within the turbine housing 30. The outlet portion 32 of the turbine housing 30 is generally tubular and is connected to the inlet portion 31 of the turbine housing 30 by an annular V-band (not shown) where the two housings meet at location 30*a*.

The outlet portion 32 of the turbine housing includes an inner tubular wall 32*a* which extends to the annular inlet passage 36 and surrounds an exducer portion 39 of the turbine wheel 38. An annular cavity 40 is defined between the tubular wall 32*a* and a surrounding wall of the housing defined in part by a wall 41 of the inlet portion 31 of the turbine housing and a wall 42 defined by the outlet portion 32 of the turbine housing. The cavity 40 is closed at one end by a generally radially extending wall portion 43 which integrally connects the tubular wall 32*a* to the outer wall 43 of the outlet portion 32 of the turbine housing. The opposite end of the cavity 40 is however open and slidably receives a movable nozzle ring 44.

The movable nozzle ring 44 is generally L-shaped in cross-section having a tubular portion 44*a* which extends into the cavity 40, and a radially extending inlet wall portion 44*b* which defines a movable wall surface of the inlet passageway 36. An annular array of inlet vanes 45 extend from the nozzle ring wall 44*b* across the inlet passage 36. The bearing housing 33 is provided with an annular cavity 46 to receive the nozzle ring vanes 45 and thereby accommodate movement of the nozzle ring 44. The cavity 46 is covered by an annular shroud plate 47 which defines vane slots (not shown) into which respective vanes 46 extend.

The nozzle ring 44 is supported on a pair of diametrically opposed support rods 48 (only one of which is visible in FIG. 2) which extend parallel to the turbine axis and are slidably supported within respective guide bushes 49 which are located in apertures provided in a radially extending support wall 50. In the illustrated embodiment the support wall 50 is an annular member which is clamped between the inlet portion 31 and outlet portion 32 of the turbine housing and which extends to the tubular wall 32*a*. The nozzle ring 44 is sealed with respect to the cavity 40 by an annular seal member 51 disposed between the tubular portion 44*a* of the nozzle ring and the wall 41 of the inlet portion 31 of the housing. The nozzle ring 44 may for instance be supported on the rods 48 in substantially the same articulated manner as shown in FIG. 1 or disclosed in U.S. Pat. No. 5,868,552.

The nozzle ring 44 may be displaced along the axis of the turbine to vary the width of the inlet 36 by an appropriate actuating mechanism (not shown) coupled to the support rods 48. The skilled person will appreciate that a variety of different forms of actuating mechanism could be employed to control movement of the nozzle ring via the support rods 48. For instance an actuator mechanism substantially as illustrated in FIG. 1 above or disclosed in U.S. Pat. No. 5,868,552 referenced above, may be used. As such, ends of the arms of a yoke (not shown) located in the cavity 40 could be connected to respective support rods 48. The yoke could for instance be operated by a shaft passing through the wall 32 of the turbine housing.

It will be appreciated that with the embodiment of the invention illustrated in FIG. 2, the provision of the movable nozzle ring within the turbine housing simplifies the structure of the bearing housing. In particular, the details of the nozzle ring and turbine housing can be changed without necessarily needing to the change the bearing housing. For instance, with the present invention the tubular wall 32*a* which surrounds the exducer portion 39 of the turbine wheel may be profiled (as illustrated) to conform to the profile of the exducer portion turbine wheel. This both permits use of a 'profiled' turbine wheel and also ensures that the exducer portion 39 of the turbine wheel 38 sweeps closely across the surface of the housing as it rotates about the turbine axis, with the minimum gap there between which maximises efficiency.

Different turbine wheel profiles can thus be accommodated simply by modifying the turbine housing 30, and in particular by changing only the configuration of the tubular wall 37 of the outlet portion 32 of the turbine housing, without the need to modify the bearing housing or indeed the inlet portion 31 of the turbine housing.

A second embodiment of the invention will now be described within reference to FIG. 3. Whereas with the embodiment of FIG. 2 the inner tubular wall 32*a* which defines the nozzle ring cavity 43 is formed integrally with the outlet portion 32 of the turbine housing (and may for instance be cast as a single component), with the embodiment of FIG. 3 an inner tubular wall is provided by a separate component as will be described.

As with the embodiment of FIG. 2, the turbine housing 60 comprises an inlet portion 61 and an outlet portion 62. The inlet portion 61 of the turbine housing is substantially the same as the inlet portion 31 of the turbine housing 30 of FIG. 2 and defines and inlet volute 63 which leads to an annular inlet passage 64 which surrounds and inducer portion 37 of a turbine wheel 38. The inlet portion 61 of the turbine housing 60 is joined to a bearing housing 65 by a V-band 66. Once again, details of the bearing housing 65 are not shown and may be entirely conventional. Similarly, the outlet portion 62 of the turbine housing 60 is connected to the inlet portion 61 via a V-band (not shown) in the region of abutment 60*a*. The outlet portion 62 of the turbine housing comprises a generally tubular portion 67 extending axially away from the turbine wheel which leads to a generally laterally extending portion 68 which is defined in part by a wall 62*a* of the outlet portion 62 of the turbine housing.

An inner tubular wall member 69 is supported within the turbine housing and comprises a tubular portion which forms a tubular wall 69*a* extending to the inlet passage 64 and surrounding an exducer portion 39 of the turbine wheel 38, and a radially extending annular wall or flange 69*b* which is clamped between the inlet portion 61 and outlet portion 62 of the turbine housing 60 to support the tubular wall member 69 in position. An annular nozzle ring cavity 70 is defined between the tubular wall 69*a* and a surrounding wall 71 of the inlet portion 61 of the turbine housing. A movable nozzle ring 72 is slidably mounted within the nozzle ring cavity 70 and sealed within respect thereto by annular seal members 73 and 74. The nozzle ring has substantially the same structure as that shown above in FIG. 1 and comprises a radially extending face 72*a* which defines one wall of the inlet passageway 64, and axially extending inner and outer annular flanges 72*b* and 72*c* respectively. An annular array of inlet vanes 75 are supported on the face 72*a* of the nozzle ring and extend across the inlet passageway 64 and into an annular cavity 76 provided by the bearing housing 65 and covered by an annular shroud plate 77 which is provided with respective vane slots (not shown) to receive the vanes 75.

In common with the first embodiment of the invention illustrated in FIG. 2, the nozzle ring 72*a* is supported on a pair of diametrically opposed support rods 78 which again may for instance be coupled to the nozzle ring in an articulated manner as shown in FIG. 1 or described in U.S. Pat. No. 5,868,552. The support rods 78 are slidably mounted within bushes 79 which are supported within respective apertures provided within the radially extending flange 69*b* of the tubular wall member 69. In this particular illustrated embodiment of the invention the movement of the nozzle ring 72 is controlled by an actuating mechanism comprising a beam 80 which is linked to the ends of each of the support rods 78. The connection to the rods 78 may be rigid, or may allow some relative movement (for instance a radially slidable connection) to accommodate thermal expansion. The beam 80 is defined on the end of a rod 81 which extends through an aperture 82 provided in the wall 62*b* of the outlet portion 62 of the turbine housing, within a bush 83, and which links the beam 80 to appropriate actuator (not shown) such as for instance a conventional pneumatic, or hydraulic or electric actuator. The beam 80 is profiled such that it does not provide any significant obstruction to the flow of exhaust gas to the outlet portion 62 of the turbine housing 60. The support rods 78 and bushes 83 provide bearing surfaces which not only provide for axial movement of the nozzle ring, but also react to torque forces generated on the nozzle ring as gas flows through the turbine.

As with the embodiment of FIG. 2, the tubular wall 69*a* of the tubular wall member 60 is profiled to match the profile of the exducer portion 39 of the turbine wheel 38 in order to maximise efficiency. With the embodiment of the invention illustrated in FIG. 3, different profile turbine wheels can readily be accommodated by appropriate selection of a tubular wall member 69 without necessitating any change to the structure of the inlet portion 61 or outlet portion 62 of the turbine housing 60, or to the nozzle ring and its actuating mechanism.

Figure 3:
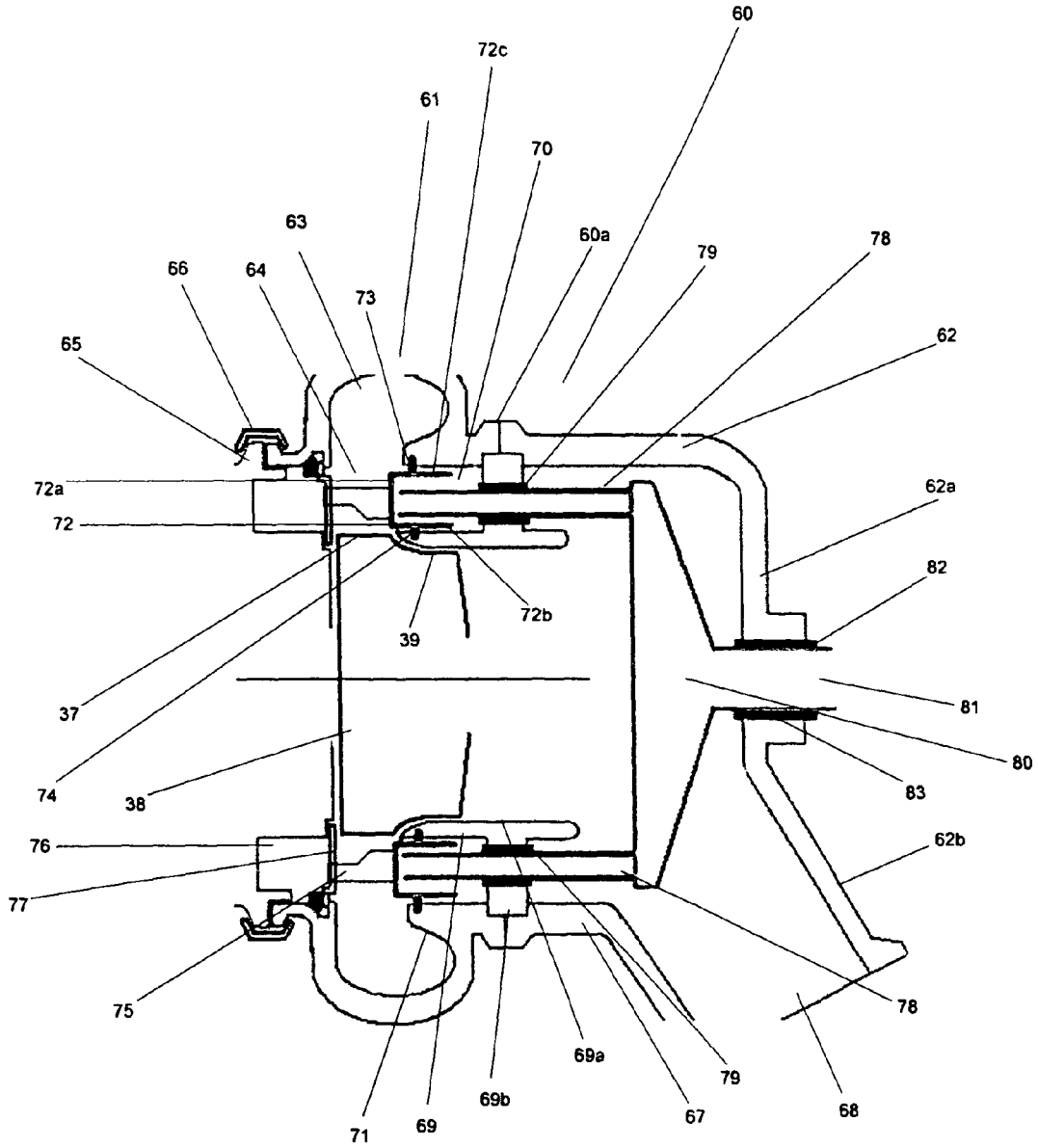
FIG. 3 shows a diagrammatic and cross section through an inlet portion of a turbine section of a variable geometry turbine in accordance with a second embodiment of the invention.

It will be appreciated that various details of the embodiments of the invention illustrated in FIGS. 2 and 3 can be modified without departing from the invention. For instance, the nozzle ring structure of FIG. 2 could be incorporated in the embodiment of the invention of FIG. 3 and vice versa. Similarly, the actuating mechanism illustrated in FIG. 3 could be applied to the embodiment of the invention illustrated in FIG. 2 by extending the support rods 48 through the radial wall 43 which connects the tubular wall 37 and surrounding wall of the outlet portion 32 of the turbine housing 30. Similarly, actuating mechanisms other than that shown in FIG. 3 can be incorporated in embodiments of the invention comprising a removable tubular wall member 69, such as for instance an actuating mechanism similar to that shown in FIG. 1 and disclosed in U.S. Pat. No. 5,868,552.

Whereas with the embodiments of FIGS. 2 and 3, the inlet vanes are supported on a movable nozzle ring, in alternative embodiments of the invention the inlet vanes may be fixed to a wall of the turbine housing, or bearing housing, and extend through vane slots provided in a moveable inlet wall member.

Figure 4:
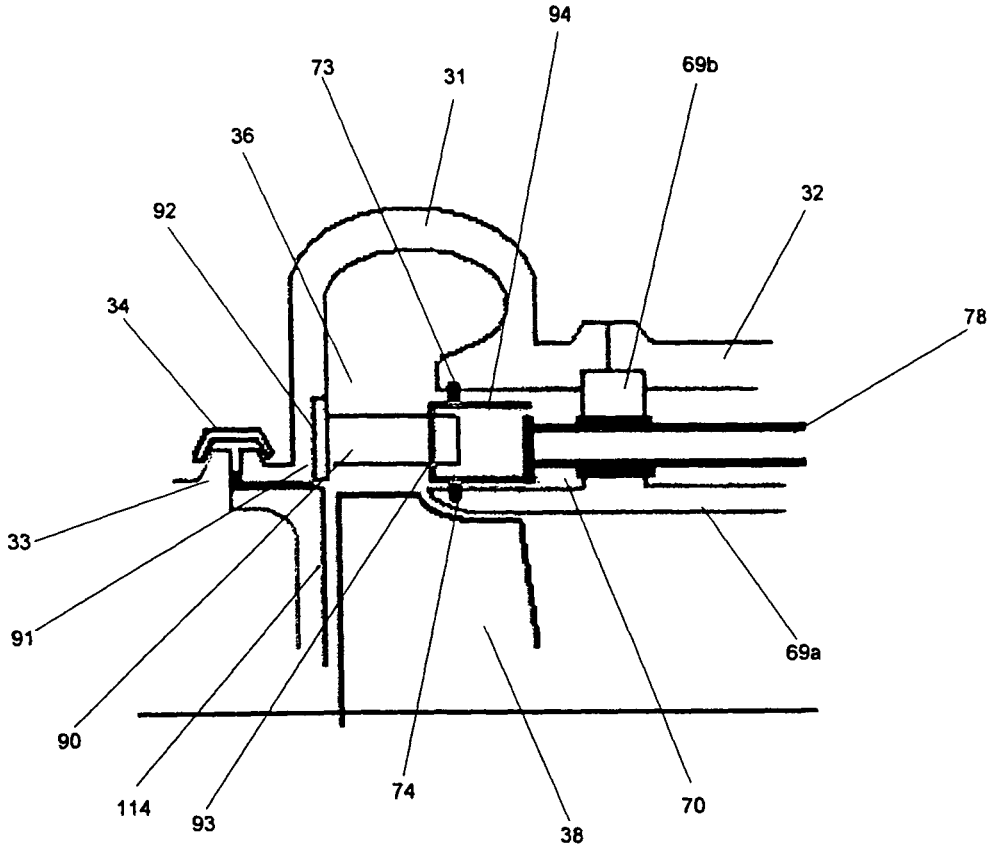
FIGS. 4 to 8 show axial cross-sectional views of the variable geometry turbines in accordance with the further embodiments of present invention.
Figure 5:
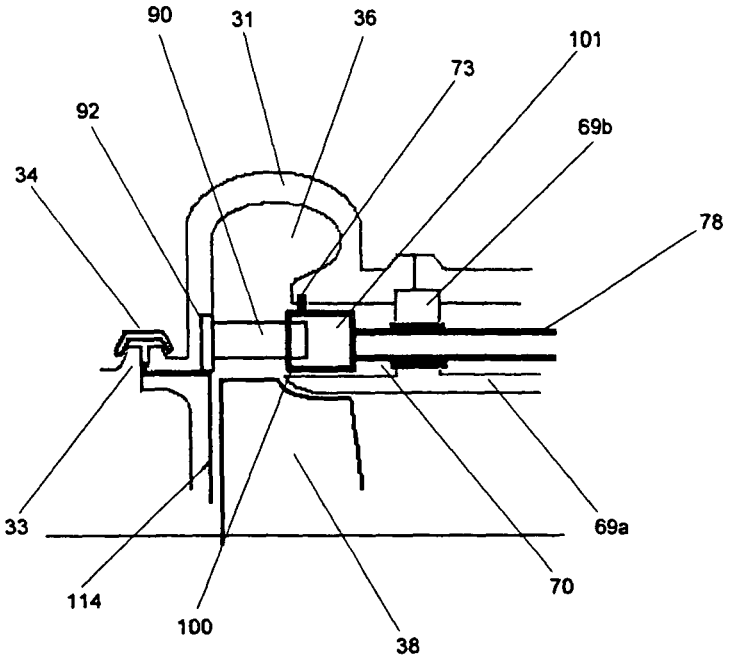
Figure 6:
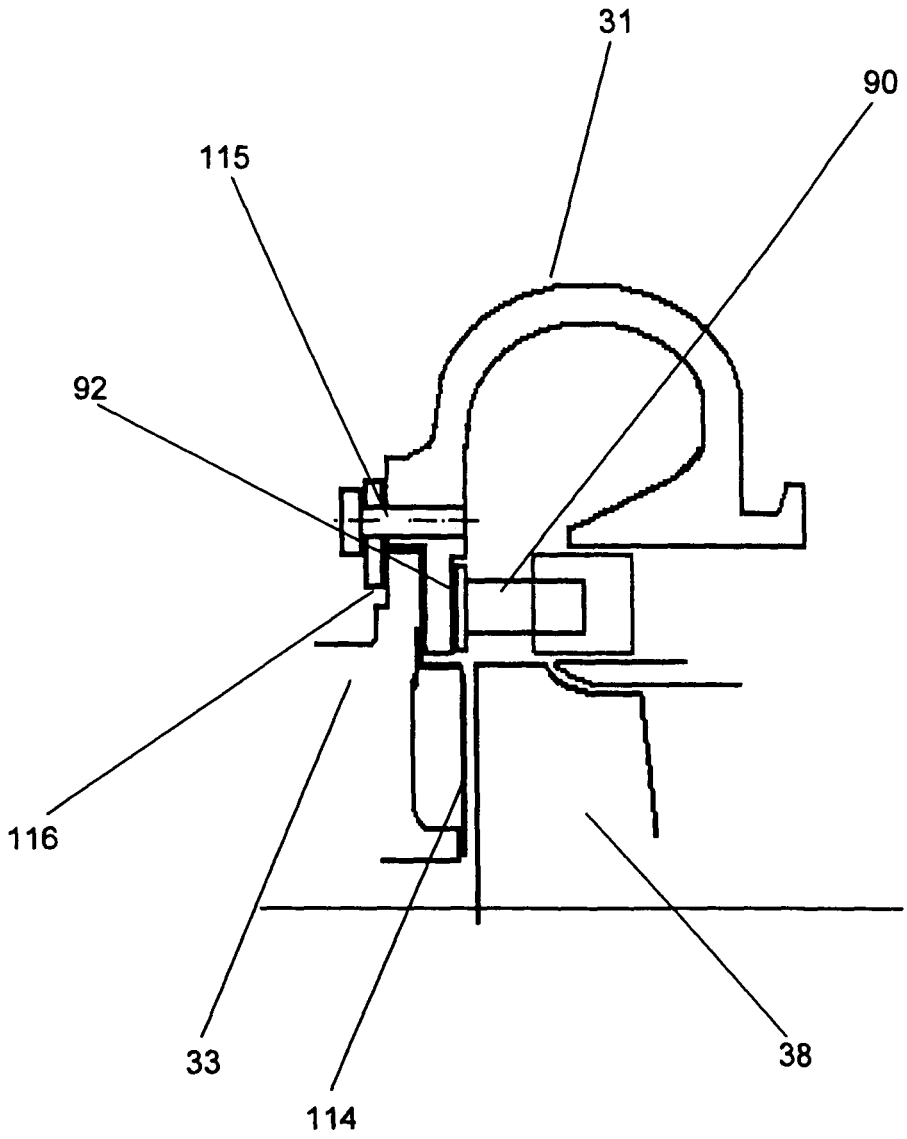

Examples of such embodiments of the invention are schematically illustrated in FIGS. 4 to 6.

Referring first to FIG. 4, and where appropriate using the same reference numerals as used in FIG. 3, inlet vanes 90 are supported on a fixed nozzle ring 91 which is mounted within an annular recess 92 defined by a wall of the inlet portion 31 of the turbine housing 33. The vanes 90 extend across the turbine inlet 36 and through vane slots (not visible in FIG. 4) provided within a radial face 93 of a movable wall member 94 which otherwise may have substantially the same configuration as the nozzle ring 72 shown in FIG. 3 (it is for instance sealed with respect to the cavity 70 by annular seals 73 and 74). A heat shield 114 is located between the bearing housing and the turbine wheel 38 and has a radially extending flange which is clamped between the bearing housing 33 and turbine housing 31 to hold the heat shield in position. Other details of the turbine structure may be as described above. In an alternative embodiment the nozzle ring may be supported by a suitable configured portion of a modified bearing housing.

Referring now to FIG. 5, and where appropriate using the same reference numerals as used in FIG. 4, this schematically illustrates a modification of the structure shown in FIG. 4 in which the movable wall member 100 has a "box-sectioned" configuration defining an internal vane cavity 101 to receive the fixed inlet vanes 90 as the nozzle ring is moved to vary the width of the inlet passage 36. In this embodiment a single annular seal member 73 is required to seal the movable wall member 100 with respect to the cavity 70.

Figure 7:
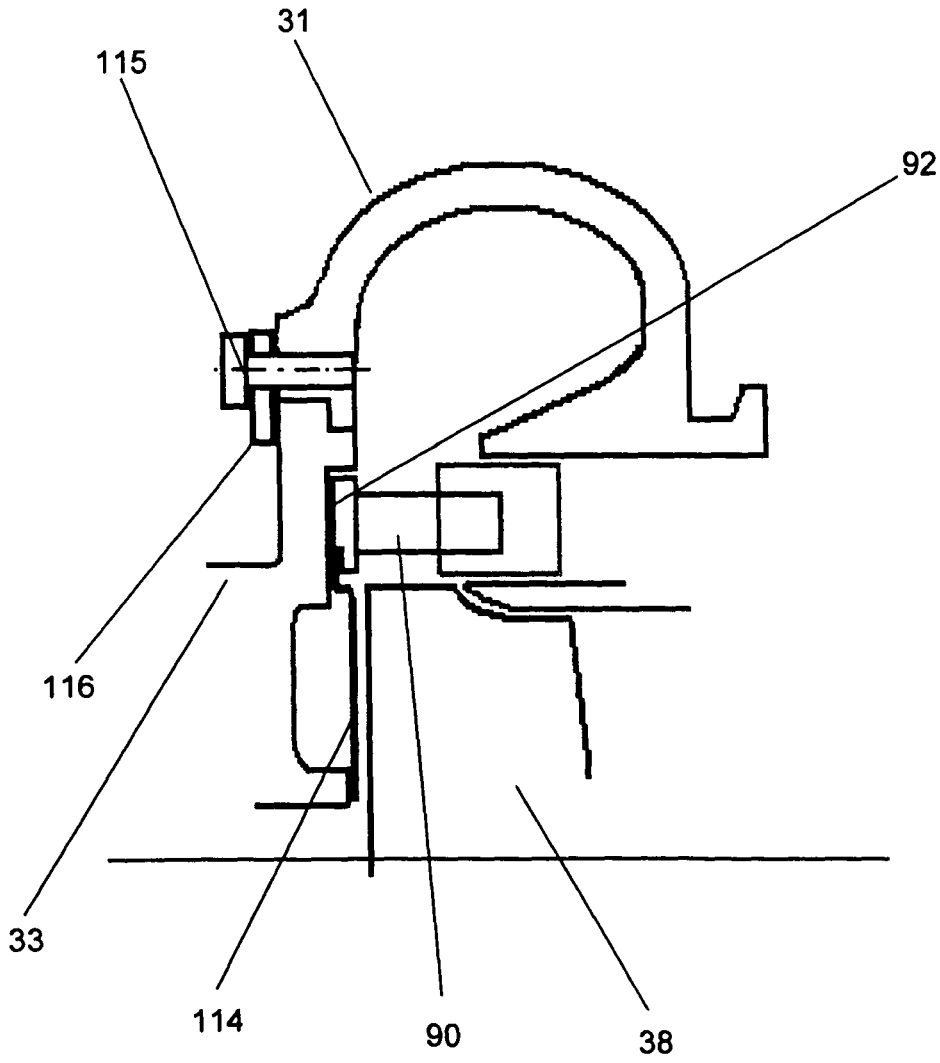

FIG. 6 illustrates a modification of the embodiment of FIG. 5 and the same reference numerals are used where appropriate. In FIG. 6, the turbine housing 31 is secured to the bearing housing 33 by clamping bolts 115 which pass through a clamping ring 116 which bridges an annular join between the bearing housing 33 and turbine housing 31. A modification of this arrangement in which the nozzle ring 92 is supported in an annular recess provided by the bearing housing rather than the turbine housing is shown in FIG. 7. In this embodiment the heat shield 114 is clamped between the fixed nozzle ring 92 and the bearing housing 33. The heat shield 92 has an annular recess to accommodate the circumferential edge of the heat shield 114. Other details of the bearing and turbine housing, including their manner of connection, are similar to those shown in FIG. 6.

Turning now to FIG. 6, and where appropriate using the same reference numerals as used in FIG. 5, this schematically illustrates a modification of the turbine housing structure shown in FIG. 5 in which the inlet vanes 90 extend from a modified nozzle ring 110. The nozzle ring 110 comprises a generally cylindrical portion 110*a* which surrounds a generally cylindrical portion 33*a* of the bearing housing 33, and a radially extending annular wall portion 110*b* which defines one radial wall of the inlet 36 and supports the nozzle vanes 90. The generally cylindrical portion 110*a* of the nozzle ring 110 includes a radially extending annular flange 111 which abuts against an annular flange provided by the bearing housing 33 and is clamped thereto by a v-band 34. A heat shield 114 is also clamped between the bearing housing 33 and nozzle ring 110. The radially extending wall 110*b* of the nozzle ring 110 mates with an annular portion of the turbine housing 31 and is clamped thereto by a clamping ring 112 secured to the inlet portion 31 of the turbine housing via bolts 113 (only one of which is shown in FIG. 6). With this arrangement the fixed nozzle ring 110 effectively provides a mechanism for joining the inlet portion 31 of the turbine housing to the bearing housing 33.

The movable wall members of the embodiments of FIGS. 4 to 6 (which may be configured as movable shroud members) can be coupled to the end of the respective support rods in substantially the same way as the moveable nozzle rings of the embodiments of FIGS. 2 and 3.

Whereas an articulated connection between the support rods and the moveable wall members (either the moveable nozzle rings of FIGS. 2 and 3 or the moveable shroud members of FIGS. 4 to 6) is advantageous in accommodating thermal expansion of the moveable wall member without distortion, in other embodiments of the invention the support rods could be rigidly connected to the moveable wall members particularly if the expansion coefficient of the tubular wall surrounding the exducer portion of the turbine wheel can be matched to the expansion coefficient of the movable wall member. Such a rigid connection may also be acceptable on smaller turbines in which differential thermal expansion between components of the turbine are smaller resulting in reduced risk of jamming due to the different degrees of thermal expansion between components. Alternatively, a degree of thermal growth due to rigidly attached support rods could be accommodated by supporting the rods (within respective bushes) within slotted apertures which allow some movement of the rods in a radial direction to accommodate differential thermal expansion. Such an arrangement could be applied to any of the embodiments described above.

Figure 8:
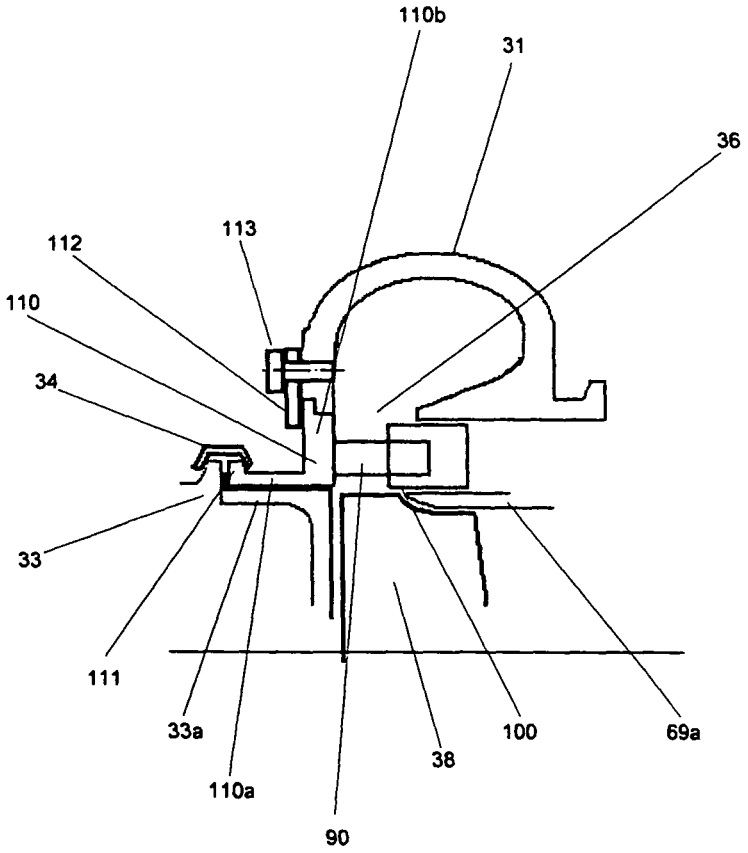

With the embodiment of FIG. 8 the cylindrical portion 33*a* of the bearing housing 33 is shown as an integral part of the bearing housing 33. However, the cylindrical portion 33*a* may be a separate component which includes an annular flange which is clamped between the bearing housing 33 and the modified nozzle ring 110. It will similarly be appreciated that different forms of connection could be made between the nozzle ring 110 and the turbine housing 31. It will also be appreciated that whereas in FIG. 6 the moveable wall member 100 is schematically shown as having the structure of the movable wall illustrated in FIG. 5, other forms of movable wall member including for instance that shown in FIG. 4, could be included in embodiments of the invention in which a fixed nozzle ring is used to join the turbine housing to the bearing housing.

As mentioned, the variable geometry turbine according to the present invention is particularly suited for inclusion in a turbocharger. However, the present invention may have other applications such as for instance power turbines. Other possible modifications of the above described embodiments of the invention, and other possible applications of the invention, would be readily apparent to the appropriately skilled person.

The invention claimed is:

1. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein the housing comprises an inlet portion defining said inlet passage and at least a portion of said surrounding wall and an outlet portion joined to said inlet portion and defining at least a portion of said outlet passage;

wherein the tubular wall is integrally formed with said outlet portion of the housing; and wherein a generally radially extending annular wall portion integral with said tubular wall and said outlet portion of the housing extends between the two and closes an axial end of the cavity remote from said inlet passage.

2. A variable geometry turbine according to claim 1, wherein said tubular wall is defined by a tubular wall member supported within said surrounding wall by at least one radial projection extending from said tubular wail member to said surrounding wall, and wherein said radial projection is secured between an inlet portion and an outlet portion of the housing.

3. A variable geometry turbine according to claim 1, wherein said surrounding wall extends axially beyond said tubular wall to define a generally tubular portion of the outlet passage downstream of said tubular wall relative to flow through the turbine.

4. A variable geometry turbine according to claim 1, wherein said outlet portion of the housing defines at least a portion of said surrounding wall.

5. A variable geometry turbine according to claim 1, wherein the tubular wall is supported by said outlet portion of the housing.

6. A variable geometry turbine according to claim 1, wherein said tubular wall is defined by a tubular wall member supported within said surrounding wall by at least one radial projection extending from said tubular wall member to said surrounding wall.

7. A variable geometry turbine according to claim 6, wherein said radial projection is secured between said inlet and outlet portions of the housing.

8. A variable geometry turbine according to claim 6, wherein said radial projection is a radially extending annular flange.

9. A variable geometry turbine according to claim 8, wherein said annular flange is integral with said tubular wall member.

10. A variable geometry turbine according to claim 1, wherein the moveable wall member is mounted on an end of at least one axially moveable rod, the or each rod extending through an aperture in said annular wall portion or radial projection for connection to an actuating mechanism.

11. A variable geometry turbine according to claim 10, comprising at least two of said axially moveable rods, and further comprising an actuating mechanism including a beam linked to each of the rods and means for displacing the beam in a direction along the axis of the turbine to thereby axially displace the moveable wall member.

12. A variable geometry turbine according to claim, 11 wherein the beam is disposed within the outlet passage downstream of said tubular wall and is connected to an actuator disposed outside of the outlet passage by a linkage which extends through a wall of the outlet passage, the actuator and linkage together comprising said means for displacing the beam.

13. A variable geometry turbine according to claim 12, wherein the outlet passage comprises a first generally tubular portion extending axially away from said tubular wall, and a second portion extending at an oblique angle to said first portion and defined at least in part by said wall of the outlet passage through which said linkage extends through.

14. A variable geometry turbine according to claim 13, wherein said linkage is a drive rod.

15. A variable geometry turbine according to claim 1, wherein the moveable wall member is mounted on an end of at least one axially moveable rod, the or each rod extending through an aperture in a radially extending support wall which extends between the tubular wall and the surrounding wall between the inlet passage and said annular wall portion or radial projection.

16. A variable geometry turbine according to claim 15, wherein said support wall is an annular flange.

17. A variable geometry turbine according to claim 15, further comprising an actuating mechanism which engages the or each rod on the opposite side of the support wall to said moveable wall member.

18. A variable geometry turbine according to claim 17, wherein the actuating mechanism comprises a yoke pivotally supported relative to the housing and defining at least one arm which extends into engagement with the or each rod.

19. A variable geometry turbine according to claim 18, wherein the arm or arms of the yoke extend through said surrounding wall of the housing.

20. A variable geometry turbine according to claim 1, wherein inlet vanes are fixed to said first inlet surface and vane slots are provided in said second inlet surface to receive said inlet vanes as the inlet surfaces move axially towards one another.

21. A variable geometry turbine according to claim 1, wherein the exducer portion of the turbine wheel defines a tubular profile as it rotates about said axis and which varies in radius along the axis, and the radially inner surface of the tubular wall has a matching tubular profile.

22. A variable geometry turbine according to claim 1, wherein said turbine housing is connected to a bearing housing defining a bearing cavity, the turbine wheel being mounted on a turbine shaft which extends through a housing wall separating the turbine wheel and bearing cavity.

23. A variable geometry turbocharger, comprising:

a variable geometry turbine including: a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein the housing comprises an inlet portion defining said inlet passage and at least a portion of said surrounding wall and an outlet portion joined to said inlet portion and defining at least a portion of said outlet passage;

wherein the tubular wall is integrally formed with said outlet portion of the housing; and wherein a generally radially extending annular wall portion integral with said tubular wall and said outlet portion of the housing extends between the two and closes an axial end of the cavity remote from said inlet passage.

24. A variable geometry turbine according to claim 1, wherein: said tubular wall is defined by a tubular wall member supported within said surrounding wall by at least one radial projection, and/or an annular wall portion, extending from said tubular wall member to said surrounding wall; the moveable wall member is mounted on an end of at least two axially moveable rods, each rod extending through an aperture in said radial projection, and/or said annular wall portion, for connection to an actuating mechanism located on the opposite side of the radial projection and/or an annular wall portion to said moveable wall member; the actuating mechanism including a beam linked to each of the rods and a yoke for displacing the beam in a direction along the axis of the turbine to thereby axially displace the moveable wall member, the yoke being pivotally supported relative to the housing and defining at least one arm which extends into engagement with each rod.

25. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

said tubular wall is defined by a tubular wall member supported within said surrounding wall by at least one radial projection extending from said tubular wall member to said surrounding wall;

the moveable wall member is mounted on an end of at least one axially moveable rod, the or each rod extending through an aperture in said radial projection for connection to an actuating mechanism.

26. A variable geometry turbine according to claim 25 comprising at least two of said axially moveable rods, and further comprising an actuating mechanism including a beam linked to each of the rods and means for displacing the beam in a direction along the axis of the turbine to thereby axially displace the moveable wall member.

27. A variable geometry turbine according to claim 26 wherein the beam is disposed within the outlet passage downstream of said tubular wall and is connected to an actuator disposed outside of the outlet passage by a linkage which extends through a wall of the outlet passage, the actuator and linkage together comprising said means for displacing the beam.

28. A variable geometry turbine according to claim 27 wherein the outlet passage comprises a first generally tubular portion extending axially away from said tubular wall, and a second portion extending at an oblique angle to said first portion and defined at least in part by said wall of the outlet passage through which said linkage extends through.

29. A variable geometry turbine according to claim 28 wherein said linkage is a drive rod.

30. A variable geometry turbocharger, comprising:

a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

said tubular wall is defined by a tubular wall member supported within said surrounding wall by at least one radial projection extending from said tubular wall member to said surrounding wall;

the moveable wall member is mounted on an end of at least one axially moveable rod, the or each rod extending through an aperture in said radial projection for connection to an actuating mechanism.

31. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

said tubular wall is defined by a tubular wall member supported within said surrounding wall by at least one radial projection extending from said tubular wall member to said surrounding wall;

wherein the moveable wall member is mounted on an end of at least one axially moveable rod, the or each rod extending through an aperture in a radially extending support wall which extends between the tubular wall and the surrounding wall between the inlet passage and said radial projection.

32. A variable geometry turbine according to claim 31 wherein said support wall is an annular flange.

33. A variable geometry turbine according to claim 31, further comprising an actuating mechanism which engages the or each rod on the opposite side of the support wall to said moveable wall member.

34. A variable geometry turbine according to claim 33, wherein the actuating mechanism comprises a yoke pivotally supported relative to the housing and defining at least one arm which extends into engagement with the or each rod.

35. A variable geometry turbine according to claim 34, wherein the arm or arms of the yoke extend through said surrounding wall of the housing.

36. A variable geometry turbocharger, comprising:

a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

said tubular wall is defined by a tubular wall member supported within said surrounding wall by at least one radial projection extending from said tubular wall member to said surrounding wall;

wherein the moveable wall member is mounted on an end of at least one axially moveable rod, the or each rod extending through an aperture in a radially extending support wall which extends between the tubular wall and the surrounding wall between the inlet passage and said radial projection.

37. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein inlet vanes are fixed to said first inlet surface and vane slots are provided in said second inlet surface to receive said inlet vanes as the inlet surfaces move axially towards one another.

38. A variable geometry turbocharger, comprising:

a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein inlet vanes are fixed to said first inlet surface and vane slots are provided in said second inlet surface to receive said inlet vanes as the inlet surfaces move axially towards one another.

39. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein the exducer portion of the turbine wheel defines a tubular profile as it rotates about said axis and which varies in radius along the axis, and the radially inner surface of the tubular wall has a matching tubular profile.

40. A variable geometry turbocharger, comprising:

a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein the exducer portion of the turbine wheel defines a tubular profile as it rotates about said axis and which varies in radius along the axis, and the radially inner surface of the tubular wall has a matching tubular profile.

41. A variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein said turbine housing is connected to a bearing housing defining a bearing cavity, the turbine wheel being mounted on a turbine shaft which extends through a housing wall separating the turbine wheel and bearing cavity.

42. A variable geometry turbocharger, comprising:

a variable geometry turbine comprising:

a turbine wheel supported in a housing for rotation about a turbine axis;

the housing defining an annular inlet passage disposed around an inducer portion of the turbine wheel and an outlet passage including a tubular wall disposed around an exducer portion of the turbine wheel;

the inlet passage being defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

the moveable wall member being displaceably mounted within an annular cavity defined between said tubular wall and a surrounding wall of the housing;

wherein said turbine housing is connected to a bearing housing defining a bearing cavity, the turbine wheel being mounted on a turbine shaft which extends through a housing wall separating the turbine wheel and bearing cavity.

* * * * *